US009175435B2

(12) United States Patent
Reinhart

(10) Patent No.: US 9,175,435 B2
(45) Date of Patent: Nov. 3, 2015

(54) APPARATUS AND METHOD FOR FOLDING FITTED BEDDING ARTICLES

(75) Inventor: Jan Reinhart, Fishers, IN (US)

(73) Assignee: Jan Reinhart, Fishers, IN (US)

( * ) Notice: Subject to any disclaimer, the term of this patent is extended or adjusted under 35 U.S.C. 154(b) by 986 days.

(21) Appl. No.: 13/213,378

(22) Filed: Aug. 19, 2011

(65) Prior Publication Data

US 2013/0045850 A1 Feb. 21, 2013

(51) Int. Cl.
*D06F 89/00* (2006.01)

(52) U.S. Cl.
CPC ..... *D06F 89/005* (2013.01)

(58) Field of Classification Search
CPC ..... B31B 1/26; B65H 45/00; D06F 89/005
USPC ..... 493/405, 406, 408, 409; 223/37, DIG. 2
See application file for complete search history.

(56) References Cited

U.S. PATENT DOCUMENTS

| | | | | |
|---|---|---|---|---|
| 2,065,989 | A | 12/1936 | Spiess | |
| 2,905,367 | A | 9/1959 | Coutu | |
| 3,236,425 | A * | 2/1966 | Sipe | 223/37 |
| 3,510,031 | A | 5/1970 | Robinson | |
| 3,689,059 | A * | 9/1972 | Gross | 269/100 |
| 3,713,643 | A * | 1/1973 | Gerstenberger | 493/405 |
| 3,884,459 | A * | 5/1975 | Gunn et al. | 493/19 |
| 3,970,226 | A | 7/1976 | Lanagan et al. | |
| 4,986,427 | A * | 1/1991 | Law et al. | 211/64 |
| 5,816,434 | A * | 10/1998 | Weinstein | 223/37 |
| 7,476,103 | B1 * | 1/2009 | Norman | 434/276 |
| 2006/0284444 | A1 * | 12/2006 | Wall | 296/136.07 |
| 2008/0264983 | A1 * | 10/2008 | Kastan | 223/38 |
| 2009/0277138 | A1 * | 11/2009 | Smith et al. | 53/473 |
| 2010/0162581 | A1 * | 7/2010 | Ward | 33/566 |
| 2015/0026887 | A1 * | 1/2015 | Taylor | 5/496 |

FOREIGN PATENT DOCUMENTS

| | | |
|---|---|---|
| GB | 613055 | 11/1948 |

OTHER PUBLICATIONS

How to fold a fitted sheet, This Old House, The Hardward Aisle, Dec. 3, 2009—http://stores.fitandfold.com/StoreFront.bok.

How to Fold a Fitted Sheet, Martha Stewart Living, Oct. 1997, http://www.marthastewart.com/article/how-to-fold-a-fitted-sheet.

* cited by examiner

*Primary Examiner* — Andrew M Tecco
(74) *Attorney, Agent, or Firm* — Krieg DeVault LLP

(57) ABSTRACT

In one embodiment, an apparatus for folding a fitted bedding article includes a folding platform having an arcuate surface configured to receive a corner of the fitted bedding article. The apparatus also includes a holding member configured to releasably hold one or more portions of the fitted bedding article relative to the folding platform when at least one corner of the fitted bedding article is positioned about the arcuate surface. In another form, a method is directed to folding a fitted bedding article. However, other embodiments, forms and applications are also envisioned.

13 Claims, 6 Drawing Sheets

APPARATUS AND METHOD FOR FOLDING FITTED BEDDING ARTICLES

BACKGROUND

The present application relates to the folding of fitted bedding articles, and more particularly, but not exclusively, to apparatuses and methods for folding fitted bedding articles that employ a folding platform having an arcuate surface.

Fitted bedding articles, such as fitted bed sheets and mattress pads that have an elastic band around all or part of their bottom edge, can be difficult to fold. Indeed, current techniques for folding fitted bedding articles require difficult manipulation of the fitted bedding articles to mate the corners of the fitted bedding article together, followed by additional folding of the fitted bedding article that must be carried out on a large flat surface, such as a bed or counter. Often times, the fitted bedding article requires additional smoothing and flattening to address wrinkles formed during the folding process. In addition, execution of this technique can be inhibited by physical limitations of the person folding the fitted bedding article and/or by the size of the fitted bedding article itself. Thus, there remains a need for further developments in this arena.

SUMMARY

One nonlimiting embodiment of the present application is directed to an apparatus for folding a fitted bedding article that includes a folding platform having an arcuate surface configured to receive a corner of the fitted bedding article. The apparatus also includes a holding member configured to releasably hold one or more portions of the fitted bedding article relative to the folding platform when at least one corner of the fitted bedding article is positioned about the arcuate surface. However, other embodiments, forms and applications are also envisioned.

Another embodiment of the present application is a unique apparatus for folding a fitted bedding article, such as a fitted sheet or bedspread. Other embodiments include unique techniques, methods, systems, devices, kits, assemblies, equipment, and/or apparatus involving the folding of a fitted bedding article.

Further embodiments, forms, features, aspects, benefits, objects and advantages of the present application shall become apparent from the detailed description and figures provided herewith.

DESCRIPTION OF THE ILLUSTRATED EMBODIMENTS

Figure 1:
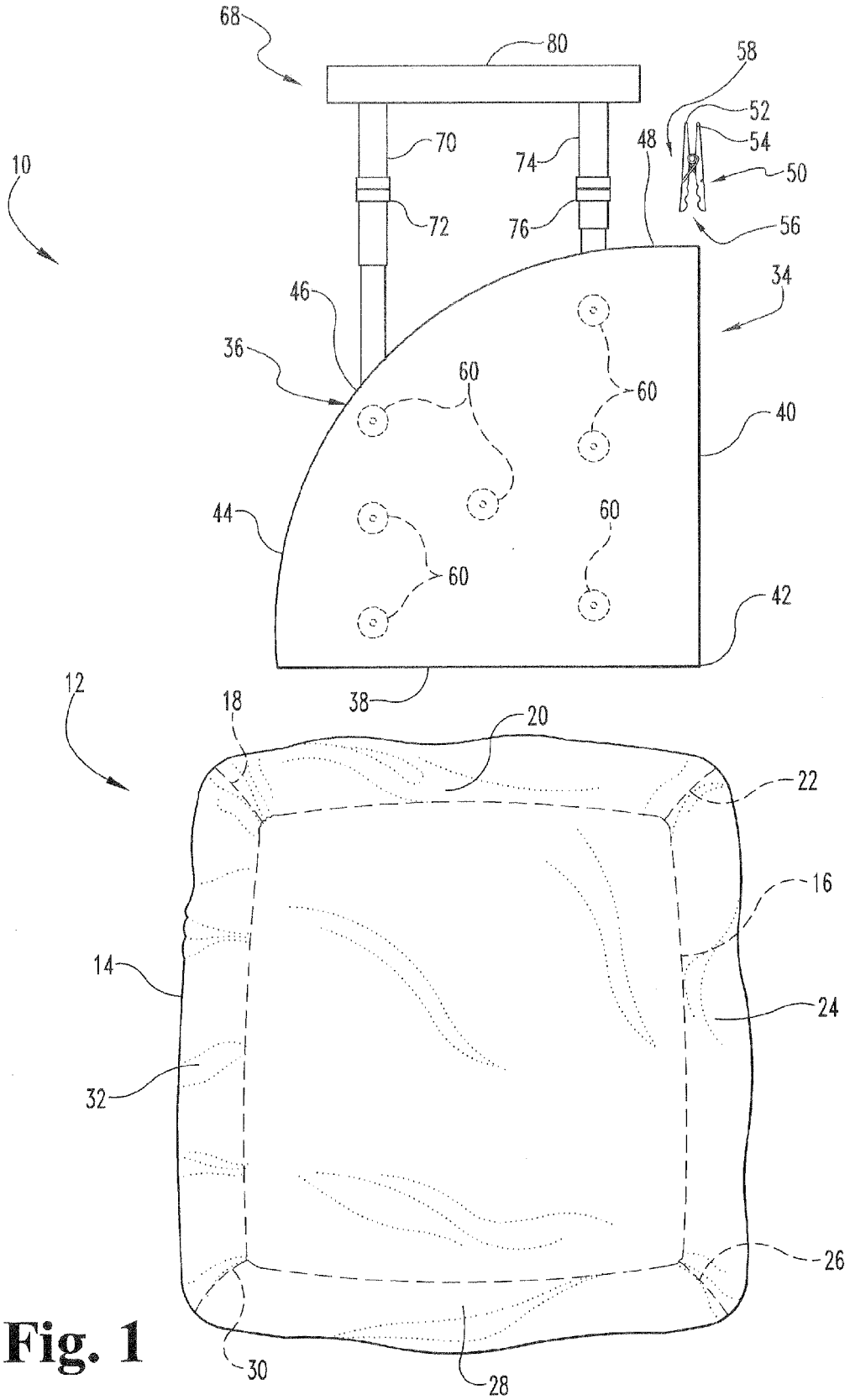
FIG. 1 is a plan view of an apparatus for folding a fitted bedding article positioned adjacent to the fitted bedding article.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated devices and described methods, and any such further applications of the principles of the invention as illustrated herein are contemplated as would normally occur to one skilled in the art to which the invention relates.

One nonlimiting embodiment of the present application is directed to an apparatus for folding a fitted bedding article that includes a folding platform having an arcuate surface configured to have a corner of the bedding article positioned thereover. The apparatus also includes a holding member configured to releasably hold one or more portions of the fitted bedding article relative to the folding platform when at least one corner of the fitted bedding article is positioned over the arcuate surface. The fitted bedding article may be folded using the apparatus by employing a technique that includes successively positioning the corners of the fitted bedding article over the arcuate surface and engaging portions of the fitted bedding article adjacent its corners with the holding member.

Referring now to FIG. 1, an apparatus 10 for folding a fitted bedding article 12 is illustrated. The fitted bedding article 12 may be in the form of a fitted sheet or bedspread, just to provide a few non-limiting examples. Article 12 generally includes a cover portion 14 and an elastic band 16 which, in the illustrated form, extends entirely around a bottom edge of cover portion 14. However, in other non-illustrated forms, it should be understood that elastic band 16 can only extend around a portion of the lower edge of cover portion 14. Article 12 generally includes a rectangular configuration defined by four corners 18, 22, 26, 30 between which elongate segments 20, 24, 28, 32 extend. It should be appreciated that the shape and configuration of article 12 is not limiting, and that use of apparatus 10 for folding alternatively shaped and configured fitted bedding articles is also possible.

Apparatus 10 includes a folding platform 34 having an arcuate surface 36 that extends between a bottom surface 38 and a side surface 40 that intersects with bottom surface 38 at a corner 42 generally positioned opposite of arcuate surface 36. In the form illustrated in FIG. 1, arcuate surface 36 has a first portion 44 that extends from bottom surface 38 to a second portion 46. Second portion 46 extends to a third portion 48 which extends to side surface 40. While each of portions 44, 46, 48 includes an arcuate or curved configuration, it should be understood that the degree of curvature varies between portions 44, 46, 48. For example, in the illustrated form, second portion 46 has a higher degree of curvature relative to first and third portions 44, 48. Similarly, arcuate surface 36 is generally provided with a varying or non-constant degree of curvature between bottom surface 38 and side surface 40. However, it should be understood that forms in which arcuate surface 36 includes a constant degree of curvature between bottom surface 38 and side surface 40 are also possible. Still, other forms for arcuate surface 36 are contemplated. In addition, while not previously discussed, it should be understood that the size and shape of arcuate surface 36 may at least partially correspond to the size and shape of corners 18, 22, 26, 30 of article 12 such that corners 18, 22, 26, 30 can be sequentially positioned along and about arcuate surface 36 while carrying out a technique for folding article 12 with folding platform 34. Further, in one form, arcuate surface 36 can be configured such that a portion of elastic band 16 positioned at and adjacent to corners 18, 22, 26, is at least partially stretched when corners 18, 22, 26, 30 are positioned along and about arcuate surface 36. Still, other configurations for folding platform 34 are contemplated, further details of which will be provided below.

Apparatus 10 also includes a holding member 50 configured to releasably engage with folding platform 34. In the illustrated form, holding member 50 is not coupled to folding platform 34, although it should be understood that forms in which holding member 50 is directly mounted to folding platform 34 or coupled to a lanyard extending from folding platform 34 are contemplated. Holding member 50 generally includes a first member 52 and a second member 54 pivotably coupled with first member 52. First and second members 52, 54 are normally biased toward one another at a first end 56, although this bias can be overcome by manipulation of first and second members toward one another at an opposite, second end 58 in order to facilitate positioning of folding platform 34 and one or more portions of article 12 between first and second members 52, 54 at first end 56. In one form, holding member 50 can be provided with a form corresponding to that of a clothespin or other similarly arranged spring-loaded clamping member. While not previously discussed, it should be understood that during folding of article 12 using apparatus 10, holding member 50 will engage with one or more portions of article 12 when one or more of corners 18, 22, 26, 30 is positioned along and about arcuate surface 36, and hold the respective one or more portions of article 12 relative to folding platform 34 at a location at or adjacent to the intersection of arcuate surface 36 and side surface 40.

Figure 2:
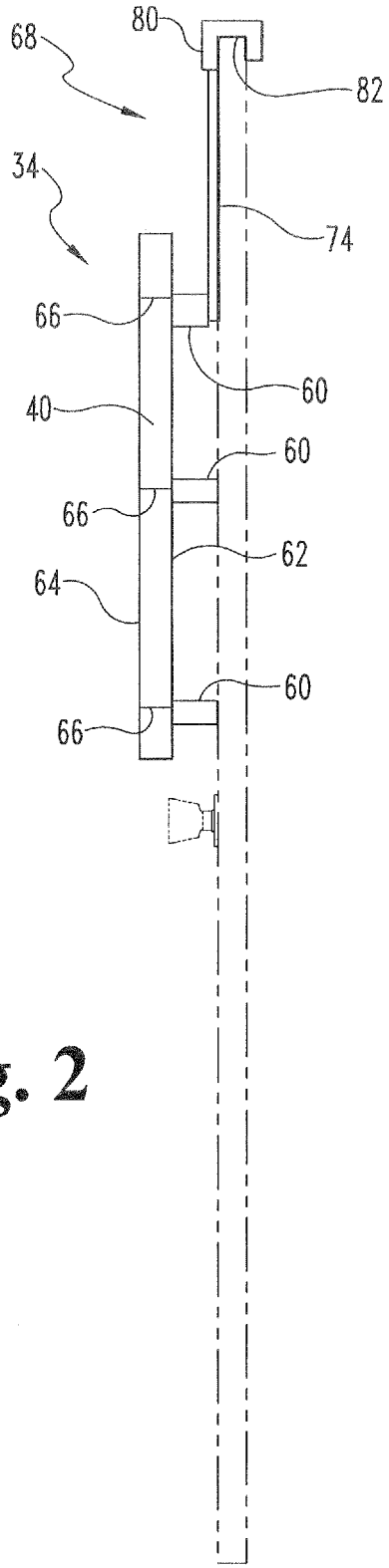
FIG. 2 is a side plan view of the apparatus illustrated in FIG. 1.

As further illustrated in FIG. 2, folding platform 34 also includes a plurality of spacers 60 extending from a first side 62 of folding platform 34 such that an oppositely positioned second side 64 of folding platform 34 is spaced apart from a mounting structure, such as a door, wall or table-top, on which folding platform 34 can be positioned. In the illustrated form, spacers 60 are coupled to folding platform 34 by a plurality of fasteners 66, non-limiting examples of which include threaded screws and bolts. However, in other forms, it is contemplated that spacers 60 may be integrally formed with folding platform 34. Still, in other non-illustrated forms, it is also contemplated that spacers 60 may be omitted from folding platform 34.

Apparatus 10 also includes a support system 68 extending from folding platform 34. Support system 68 includes a first strap 70 coupled with folding platform 34 and including an adjustment mechanism 72, such as a buckle or ratchet, to facilitate adjustments to the length of first strap 70. Support system 68 also includes a second strap 74 coupled with folding platform 34 and including an adjustment mechanism 76, such as a buckle or ratchet, to facilitate adjustments to the length of first strap 74. As illustrated in FIG. 2 for example, second strap 74 is coupled to folding platform 34 along an end of a spacer 60 positioned away from first side 62 of folding platform 34. In other forms, it should be understood that second strap 74 may be coupled to folding platform 34 along an end of the spacer 60 positioned adjacent to first side 62. In addition, while not illustrated with respect to first strap 70, it should be understood that it may be coupled to folding platform 34 in a manner similar to that discussed in connection with second strap 74. Forms in which first and second straps 70, 64 are non-adjustable and/or integrally formed with folding platform 34 are also possible. Additionally, it should be appreciated that alternative support members could be used in addition to or in lieu of first and second straps 70, 74. For example, in one or more non-illustrated forms, support system 68 may be provided with rigid or semi-rigid support members, such as plastic hangers or supports which may be fixed or adjustable, in lieu of first and second straps 70, 74, although other variations are also possible.

Figure 3:
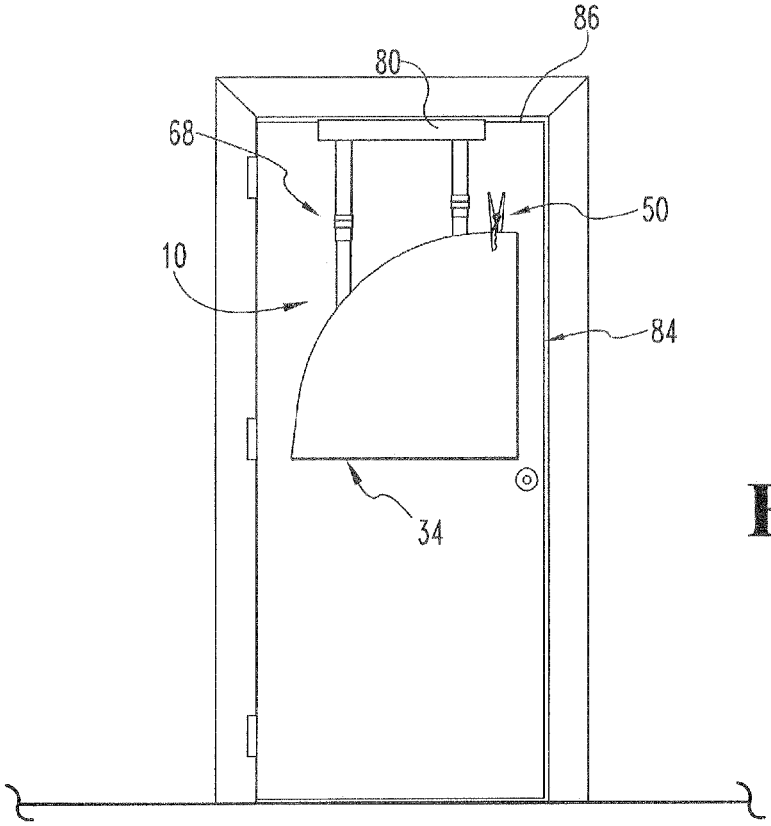
FIG. 3 is an elevation view of the apparatus illustrated in FIG. 1 removably positioned on a door.

Support system 68 also includes a transverse member 80 extending between and coupled with first and second straps 70, 74. As illustrated in FIG. 2 for example, transverse member 80 includes a channel 82 which is configured to facilitate placement of transverse member 80 over the top of a door with a portion of the door positioned in channel 82. More particularly, as illustrated in FIG. 3 for example, apparatus 10 is removably positioned on a door 84 with transverse member 80 of support system 68 positioned in engagement with the top 86 of door 84. In other forms however, it should be understood that transverse member 82 can be configured for engagement with one or more hooks or similar features positioned on the door or a wall. In this arrangement, apparatus 10 can be hung on door 84 while needed for folding article 12, and then subsequently removed for storage at another location. Moreover, while not previously discussed, it should be appreciated that the adjustability of straps 70, 74 allows the height of folding platform 34 to be moved relative to door 84 when transverse member 82 is engaged therewith.

Figure 4:
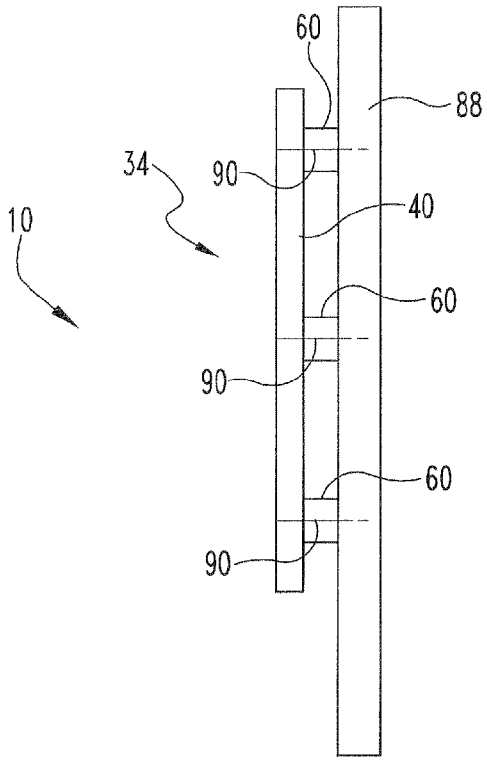
FIG. 4 is a side plan view of the apparatus illustrated in FIG. 1 engaged with a wall.

Still, it is also contemplated that folding platform 34 can be more permanently mounted to a mounting structure, such as a door or wall, just to provide a few non-limiting examples. For example, as illustrated in FIG. 4, support system 68 has been removed from folding platform 34 and folding platform 34 has been affixed to a wall 88 by a plurality of fasteners or anchors 90 that extend through folding platform 34 and a number of spacers 60 into wall 88. Still, as will be discussed in greater detail below, other arrangements for mounting or affixing folding platform 34 to a mounting structure are also possible. It is also contemplated that folding platform 34 can be positioned on or affixed to other structures besides a door or wall. For example, folding platform 34 may also be positioned on or affixed to a cleaning cart, washing machine, or dryer, just to provide a few non-limiting examples.

Referring again generally to FIG. 1, further details regarding one non-limiting technique for folding article 12 using apparatus 10 will be provided. More particularly, once folding platform 34 is positioned on an appropriate mounting structure, such as door 84, corner 18 can be positioned along and about arcuate surface 36 such that a portion of elastic band 16 extending in and around corner 18 is positioned on first surface 62 of folding platform 34. Once corner 18 is positioned along and about arcuate surface 36, a portion of elongate segment 20 adjacent to corner 18 is engaged with holding member 50 and held against folding platform 34 at or adjacent to the intersection of arcuate surface 36 and side surface 40. Corner 22 can then be positioned along and about arcuate surface 36 over corner 18 and in a manner similar to that described in connection with the positioning of corner 18. Once corner 22 is positioned along and about arcuate surface 36, a portion of elongate segment 24 adjacent to corner 22 is positioned over the portion of elongate segment 20, and both portions are held against folding platform 34 by holding member 50 at or adjacent to the intersection of arcuate surface 36 and side surface 40. Corner 26 can then be positioned along and about arcuate surface 36 over corners 18 and 22 and in a manner similar to that described in connection with the positioning of corner 18. Once corner 26 is positioned along and about arcuate surface 36, a portion of elongate segment 28 adjacent to corner 26 is positioned over the portions of elongate segments 20 and 24, and all three portions are held against folding platform 34 by holding member 50 at or adjacent to the intersection of arcuate surface 36 and side surface 40. Corner 30 can then be positioned along and about arcuate surface 36 over corners 18, 22 and 26 and in a manner similar to that described in connection with the positioning of corner 18. Once corner 30 is positioned along and about arcuate surface 36, a portion of elongate segment 32 adjacent to corner 30 is positioned over the portions of elongate segments 20, 24 and 28, and all four portions are held against folding platform 34 by holding member 50 at or adjacent to the intersection of arcuate surface 36 and side surface 40.

After all of corners 18, 22, 26, 30 have been positioned along and about arcuate surface 36, holding member 50 can be disengaged from elongate segments 20, 24, 28, 32 and article 12 can be removed from folding platform 34 with each of corners 18, 22, 26, 30 mated together. In this arrangement, article 12 can easily be subjected to one or more folding steps to provide article 12 with a neat, folded arrangement for storage in a closet or other suitable location. While the technique described above for folding article 12 with apparatus 10 started with positioning corner 18 along and about arcuate surface 36 and worked in a clockwise orientation until corner 30 was positioned along and about arcuate surface 36, it should be appreciated that a different one of corners 18, 22, 26, 30 could first be positioned along and about arcuate surface 36 followed by successive placement of the remaining corners along and about arcuate surface 36 working in a clockwise or counter-clockwise orientation. Still, in another variant of the technique for folding article 12 with apparatus 10, it is contemplated that successive positioning of corners 18, 22, 26, 30 may not occur in a clockwise or counter-clockwise working order such that corners not positioned immediately adjacent to one another are positioned along and about arcuate surface 36 in immediately adjacent steps of the technique. However, as would be appreciated by those skilled in the art, other variations in the technique for folding article 12 with apparatus 10 are possible and contemplated.

Figure 5:
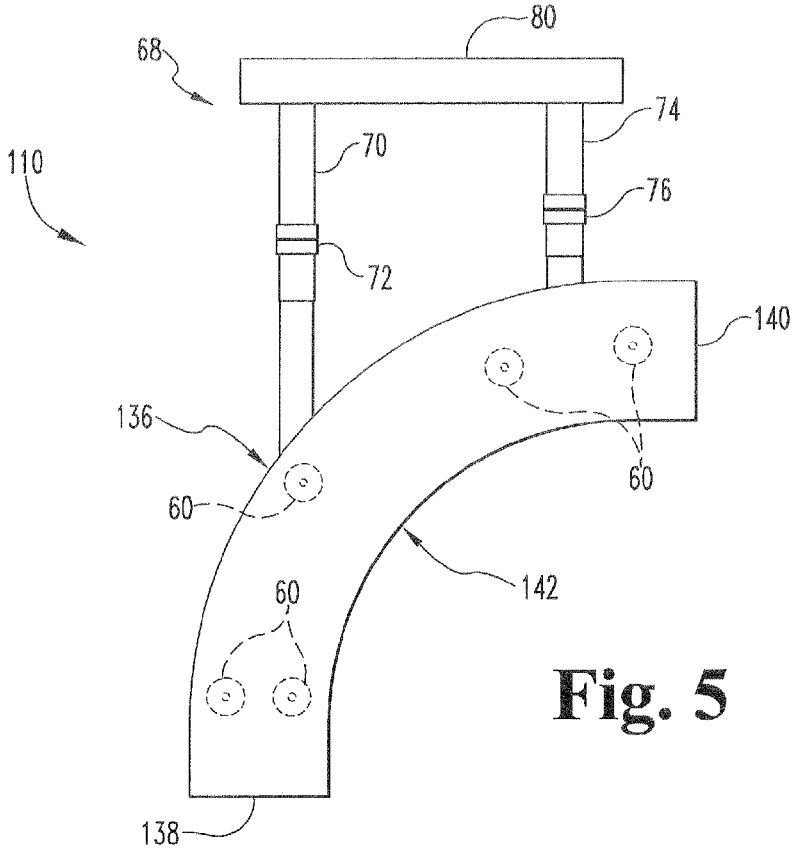
FIG. 5 is a plan view of an alternative embodiment apparatus for folding a fitted bedding article.

As indicated above, alternative configurations for folding platform 34 are possible. For example, referring now to FIG. 5 where like numerals refer to like features previously described, an alternative embodiment apparatus 110 for folding fitted bedding article 12 is shown. Apparatus 110 is substantially similar to apparatus 10, provided however that folding platform 134 has a different configuration relative to folding platform 34. More specifically, folding platform 134 has a first arcuate surface 136 that can be configured similar to arcuate surface 36 of folding platform 24 and that extends between a bottom surface 138 and a side surface 140. In contrast to the configuration of folding platform 34 however, bottom surface 138 and side surface 140 do not intersect with one another. Rather, folding platform 134 includes a second arcuate surface 142 that is positioned opposite of first arcuate surface 136 and extends between bottom and side surfaces 138, 140. Second arcuate surface 142 can be configured the same as or substantially similar to first arcuate surface 136.

Figure 6:
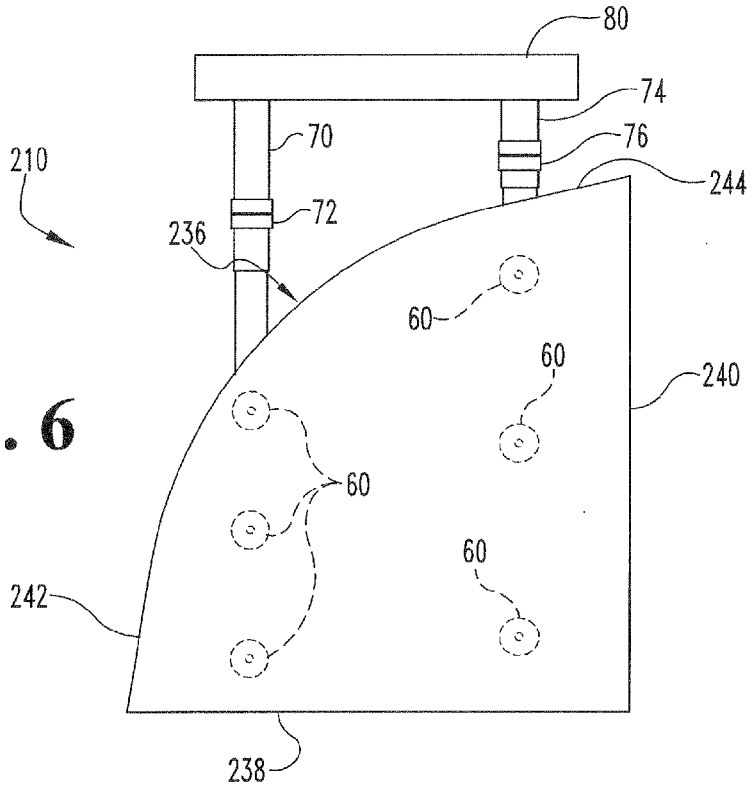
FIG. 6 is a plan view of another alternative embodiment apparatus for folding a fitted bedding article.

As another example of an alternative configuration for folding platform 34, another alternative embodiment apparatus 210 is illustrated in FIG. 6, where like numerals refer to like features previously described. Apparatus 210 is substantially similar to apparatus 10, provided however that folding platform 234 has a different configuration relative to folding platform 34. More specifically, folding platform 234 has an arcuate surface 236, a first linear surface 242 that extends from arcuate surface 236 to bottom surface 238, and a second linear surface 244 that extends from arcuate surface 236 to side surface 240. Similar to folding platform 34, bottom and side surfaces 238, 240 intersect with one another at a corner that is generally positioned opposite of arcuate surface 236.

Figure 7:
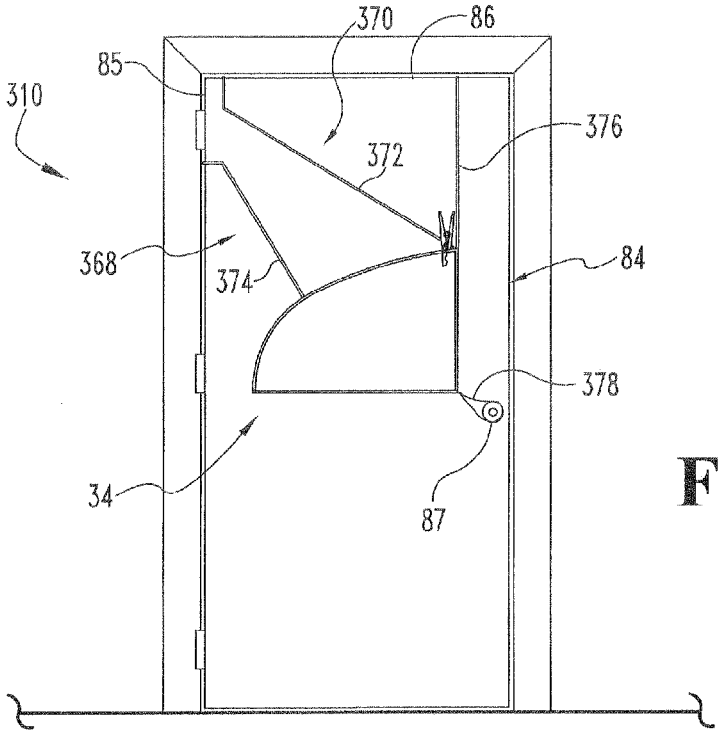
FIG. 7 is an elevation view of another alternative embodiment apparatus for folding a fitted bedding article removably positioned on a door.

As indicated above, other arrangements for mounting or affixing folding platform 34 to a mounting structure are possible. For example, referring now to FIG. 7 where like numerals refer to like features previously described, an alternative embodiment apparatus 310 for folding fitted bedding article 12 is shown. Apparatus 310 is substantially similar to apparatus 10, provided however that support system 368 has a different configuration relative to support system 68. More specifically, support system 368 includes a first member 370 having a pair of arms 374, 376 coupled with folding platform 34 and extending to a mounting portion which is configured to be positioned over corner 85 of door 84. Support system 368 also includes a second member 376 coupled with folding platform 34 and extending to a mounting portion configured to be positioned over the top 86 of door 84. Apparatus 310 also includes a stabilizing member 378, non-limiting examples of which include a cord, tether, or rope, that is coupled to folding platform 34 and includes an end configured for engagement with knob or handle 87 of door 84.

Figure 8:
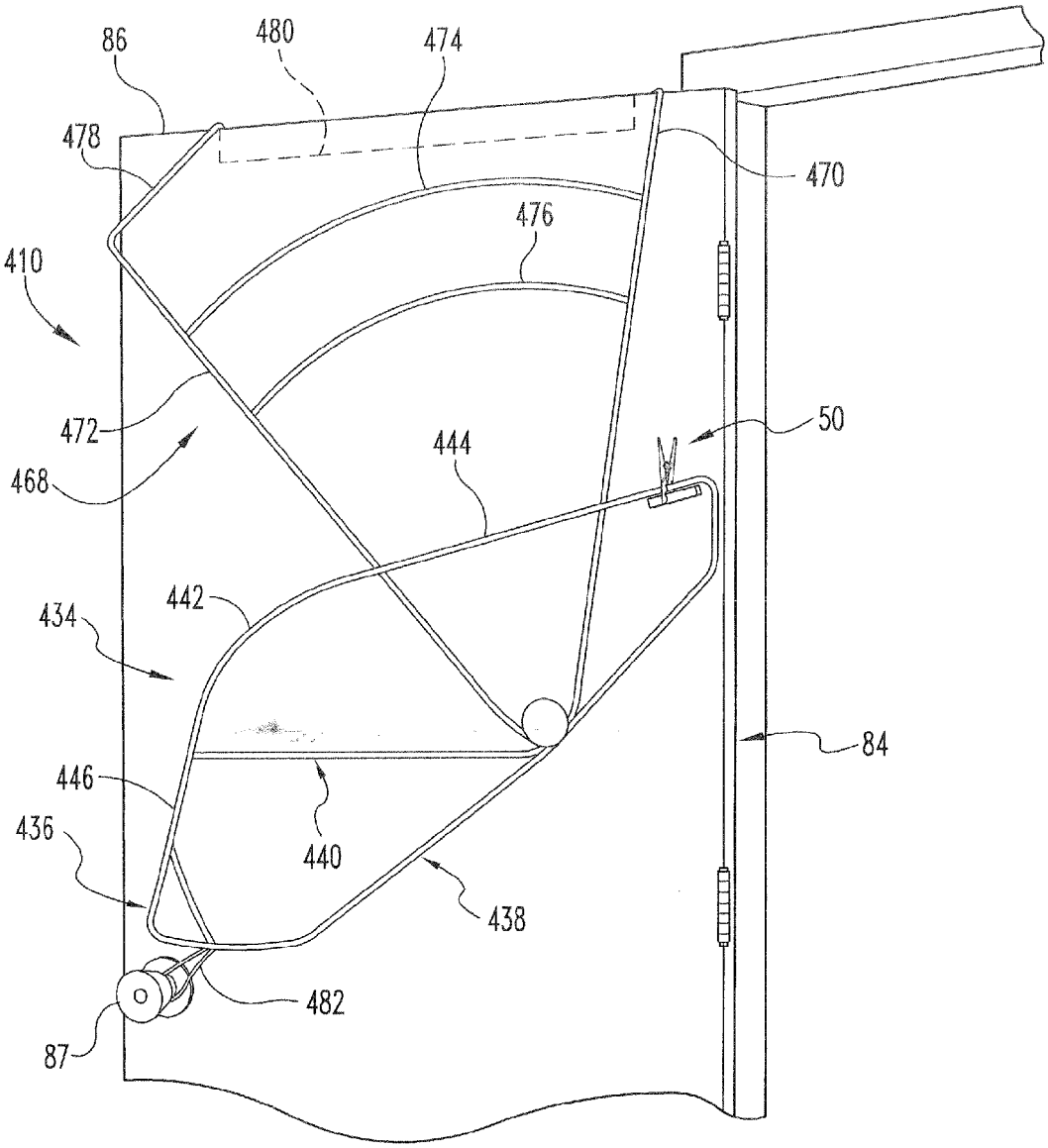
FIG. 8 is a perspective view of another alternative embodiment apparatus for folding a fitted bedding article removably positioned on a door.

Another alternative embodiment apparatus 410 for folding fitted bedding article 12 is shown removably mounted on door 84 in FIG. 8, where like numerals refer to like features previously described. Apparatus 410 is similar to apparatus 10, provided however that folding platform 434 and support system 468 have different configurations relative to folding platform 34 and support system 68. More specifically, folding platform 434 is formed by a first member 436, a second member 438 and a third member 440 extending between first and second members 436, 438. In this arrangement, folding platform 434 generally includes a hollow or open configuration formed by spaces extending between first, second and third members 436, 438 and 440. Folding platform 434 also includes an arcuate surface 442 formed along first member 436 between linear sections 444 and 446. Additionally, while not illustrated, it should be appreciated that folding platform 434 may be provided with one or more spacers similar to spacers 60 to space it apart from door 84.

Support system 468 includes a first member 470 which extends upwardly from second member 438 to a transverse member 80 configured to be positioned over the top 86 of door 84. Support system 468 also includes a second member 472 which extends upwardly from second member 438 to an intermediate section 478 which extends to transverse member 80 opposite of first member 470. A pair of braces 474, 476 extend between first and second members 470, 472. Apparatus 410 also includes a stabilizing member 482, non-limiting examples of which include a cord, tether, or rope, that is coupled to folding platform 434 and includes an end configured for engagement with knob or handle 87 of door 84. While not previously discussed, it should be appreciated that apparatus 410 may be used for folding fitted bedding article 12 in a manner similar to that described above in connection with apparatus 10.

Figure 9:
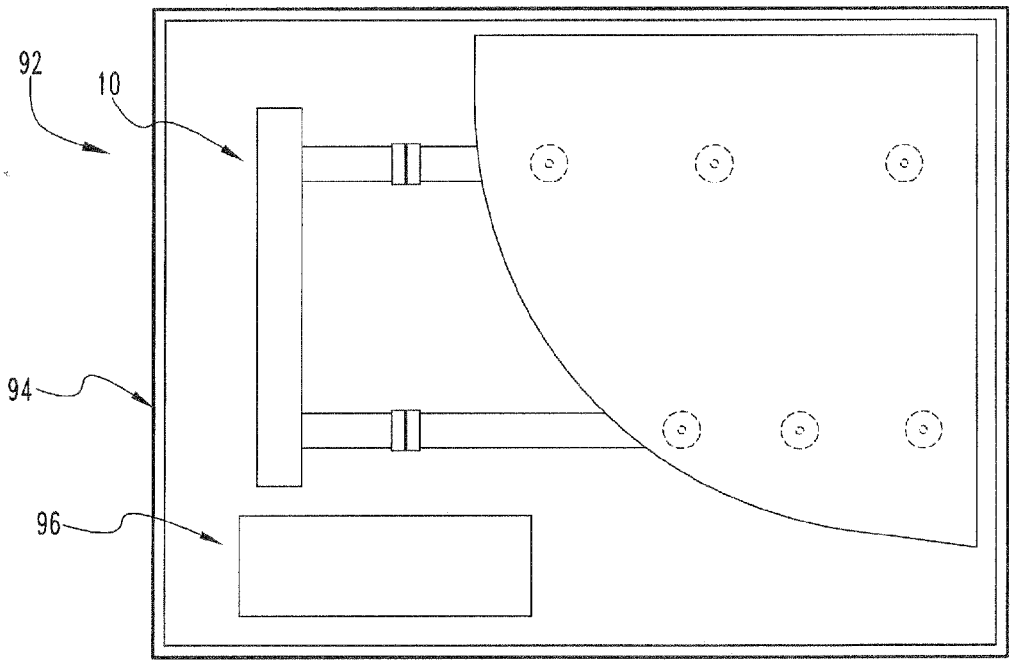
FIG. 9 is a schematic illustration of a kit including the apparatus illustrated in FIG. 1 and instructions for folding a fitted bedding article with the apparatus illustrated in FIG. 1.

Referring now to FIG. 9, a kit 92 includes packaging 94 or other suitable structure for containing apparatus 10 and instructions 96 that provide directions for folding fitted bedding article 12 with apparatus 10. Instructions 96 may also provide directions for mounting apparatus 10 to a door, wall or other suitable mounting structure. It should be appreciated that any one of apparatuses 110, 210, 310 may be provided in kit 92 in lieu of apparatus 10, and that instructions 96 may provide directions for using the respective one of apparatuses 110, 210, 310 provided in kit 92 in place of apparatus 10. In addition, while not previously discussed, it should be appreciated that each of apparatuses 110, 210, 310 can be used for folding fitted bedding article 12 in a manner similar to that described above in connection with apparatus 10.

In one embodiment, an apparatus for folding a fitted bedding article includes a folding platform having a first arcuate surface configured to receive a corner of the fitted bedding article thereabout. The apparatus also includes a holding member configured to releasably hold one or more portions of the fitted bedding article relative to the folding platform when at least one corner of the fitted bedding article is positioned about the first arcuate surface.

In another embodiment, a method includes providing a fitted bedding article having a plurality of corners; providing a folding platform having an arcuate surface and a holding member configured to releasably engage with one or more portions of the fitted bedding article; and positioning a first one of the plurality of corners about the arcuate surface of the folding platform and engaging a first portion of the fitted bedding article with the holding member to hold the first portion relative to the folding platform.

In yet another embodiment, a kit for folding a fitted bedding article includes a folding platform having an arcuate surface; a holding member configured to releasably hold one or more portions of the fitted bedding article relative to the folding platform; and instructions for folding the fitted bedding article with the folding platform.

It should be appreciated that the above-described embodiments are non-limiting, and that variations to the same are possible and contemplated. Additionally, it should be understood that features described in connection with one embodiment are not limited to that embodiment and may be included in a different embodiment in addition or in lieu of similar or non-similar features present in the other embodiment.

Any theory, mechanism of operation, proof, or finding stated herein is meant to further enhance understanding of the present application and is not intended to make the present application in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the application, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

While the application has been illustrated and described in detail in the drawings and foregoing description, the same is to be considered as illustrative and not restrictive in character, it being understood that only the selected embodiments have been shown and described and that all changes, modifications and equivalents that come within the spirit of the application as defined herein or by any of the following claims are desired to be protected.

What is claimed is:

1. An apparatus for folding a fitted bedding article, comprising:

a folding platform having a first arcuate edge surface configured to receive a corner of said fitted bedding article thereabout, and a second edge surface, said first arcuate edge surface and said second edge surface each forming a part of a perimeter of said folding platform;

said folding platform further having a front surface and a back surface each extending between said first arcuate edge surface and said second edge surface;

a plurality of spacers positioned to project beyond said back surface so as to space said folding platform from a surface of a mounting structure to which said apparatus is mounted; and a holding member coupled to said folding platform and configured to releasably hold one or more portions of said fitted bedding article relative to said folding platform when at least one corner of said fitted bedding article is positioned about said first arcuate surface, wherein said folding platform includes a side surface and a bottom surface, said side and bottom surfaces intersecting at a corner positioned opposite of said first arcuate surface, and wherein said first arcuate surface extends between and intersects with each of said side and bottom surfaces.

2. The apparatus of claim 1, wherein said second edge surface includes a first linear surface extending from a first side of said first arcuate surface and intersecting with said side surface and a second linear surface extending from an opposite second site of said first arcuate surface and intersecting with said bottom surface.

3. The apparatus of claim 1, wherein said folding platform includes a side surface and a bottom surface between which said first arcuate surface extends.

4. The apparatus of claim 3, wherein said folding platform further includes a second arcuate surface positioned opposite of said first arcuate surface and extending between said side surface and said bottom surface.

5. The apparatus of claim 1, further comprising a plurality of fasteners configured for engagement with a mounting structure through said spacers.

6. The apparatus of claim 1, further comprising a support system extending from said folding platform.

7. The apparatus of claim 6, wherein said support system includes a pair of adjustable straps each extending between a first end engaged to said folding platform and a second end coupled to a transverse member.

8. The apparatus of claim 1, wherein said holding member includes at least one engaging member normally biased into engagement with said folding platform.

9. The apparatus of claim 1, wherein said holding member is engageable with said folding platform adjacent to said first arcuate surface.

10. A method, comprising:

positioning a first one of a plurality of corners of a fitted bedding article about an arcuate surface of a folding platform supported on a mounting structure;

engaging a first portion of said fitted bedding article that is adjacent said first one of the plurality of corners with a holding member to hold said first portion relative to said folding platform;

positioning each of a second, third and fourth one of the plurality of corners of the fitted bedding article successively about the arcuate surface; and disengaging the holding member after the positioning so as to release the fitted bedding article from the folding platform with the plurality of corners mated together via the positioning.

11. The method of claim 10, which further includes engaging a second portion of said fitted bedding article adjacent said second one of said plurality of corners with said holding member to hold said first and second portions relative to said folding platform.

12. A kit for folding a fitted bedding article, comprising:

a folding platform having an arcuate edge surface and a second edge surface, said arcuate edge surface and said second edge surface each forming a part of a perimeter of said folding platform;

said folding platform further having a front surface and a back surface each extending between said first arcuate edge surface and said second edge surface;

a plurality of spacers positioned to project beyond said back surface so as to space said folding platform from a surface of a mounting structure;

a holding member configured to releasably hold one or more portions of said fitted bedding article relative to said folding platform; and instructions for folding said fitted bedding article with said folding platform, wherein said instructions include directions for positioning a first corner of the fitted bedding article about said arcuate surface of said folding platform, holding a portion of said fitted bedding article adjacent said first corner relative to said folding platform with said holding member, and positioning a second corner of said fitted bedding article about said arcuate surface of said folding platform and over said first corner of said fitted bedding article.

13. The kit of claim 12, wherein said instructions include directions for mounting said folding platform on a wall or door.

* * * * *